US005725690A

United States Patent [19]

Ochi et al.

[11] Patent Number: 5,725,690

[45] Date of Patent: Mar. 10, 1998

[54] LONG-LIFE INDUCTION-HARDENED BEARING STEEL

[75] Inventors: Tatsuro Ochi; Yuji Kawauchi, both of Muroran, Japan

[73] Assignee: Nippon Steel Corporation, Tokyo, Japan

[21] Appl. No.: 676,336

[22] PCT Filed: Nov. 24, 1995

[86] PCT No.: PCT/JP95/02394

§ 371 Date: Jul. 18, 1996

§ 102(e) Date: Jul. 18, 1996

[87] PCT Pub. No.: WO96/16195

PCT Pub. Date: May 30, 1996

[30] Foreign Application Priority Data

Nov. 24, 1994 [JP] Japan ..... 6-289643

[51] Int. Cl.[6] ..... C22C 38/02; C22C 38/06

[52] U.S. Cl. ..... 148/320; 148/328; 148/330; 148/333; 148/334; 148/335; 148/906

[58] Field of Search ..... 420/128, 105, 420/106, 108, 109, 110, 112; 148/330–335, 320, 328, 906

[56] References Cited

U.S. PATENT DOCUMENTS

| | | | |
|---|---|---|---|
| 4,642,219 | 2/1987 | Takata et al. | 420/128 |
| 5,013,525 | 5/1991 | Hamada et al. | 420/105 |

FOREIGN PATENT DOCUMENTS

| | | | |
|---|---|---|---|
| A-55-145158 | 11/1980 | Japan . | |
| 61-117247 | 6/1986 | Japan . | |
| 61-213348 | 9/1986 | Japan . | |
| A-1-255651 | 10/1989 | Japan . | |
| 2-194144 | 7/1990 | Japan . | |
| 6-78566 | 10/1994 | Japan . | |
| A 7-54103 | 2/1995 | Japan . | |
| A-8-3682 | 1/1996 | Japan . | |
| 759612 | 8/1980 | U.S.S.R. | 420/128 |

OTHER PUBLICATIONS

Bulletin of Japan Institute of Metals, vol. 68, No. 6, pp. 441–443 (1993).

*Primary Examiner*—Deborah Yee
*Attorney, Agent, or Firm*—Kenyon & Kenyon

[57] ABSTRACT

This invention aims at providing a induction hardened bearing steel which can produce bearing parts at a low cost and can provide excellent rolling fatigue characteristics, the present invention provides a long life high-frequency-hardened bearing steel comprising, in terms of percent by weight, 0.45 to 0.7% of C, 0.05 to 1.7% of Si, 0.35 to 2.0% of Mn, 0.001 to 0.03% of S, 0.01 to 0.07% of Al 0.003 to 0.015% of N, 0.0005 to 0.03% of T.Mg, 0.005 to 1.2% of Mo, a specific amount of at least one member selected from the group consisting of Cr, Ni, V, Nb and B, and more than 0.025% of P, and not more than 0.004% of Ti and not more than 0.002% of T.O, wherein a number ratio of Mg type oxides contained in the steel is at least 0.8.

11 Claims, No Drawings

LONG-LIFE INDUCTION-HARDENED BEARING STEEL

FIELD OF THE INVENTION

This invention relates to a long-life induction-hardened bearing steel. More particularly, the present invention relates to a steel which is produced through a step of controlling oxide inclusions and a induction hardening step, and which will be suitable for bearing parts such as outer rings, inner rings, rollers, etc, used under high load conditions.

BACKGROUND OF THE INVENTION

An improvement in rolling fatigue life of bearing parts has been strongly required due to the higher power of automobile engines and the stricter environmental regulations introduced in recent years. To cope with such a demand, longer service life has been sought by attaining higher cleanness of a steel because it was believed that rolling fatigue failure of the bearing parts originates from non-metallic inclusions as the starting points. For example, the Japan Institute of Metals, Vol. 32, No. 6, pp. 411–443 reports that quantities of oxide type inclusions can be reduced by the combination of an eccentric furnace bottom tapping technique, an RH vacuum degassing method, etc, and rolling fatigue life can be thus improved. However, longer life by this method is not always sufficient, and particularly when the bearing is used under a high load condition, the development of a steel having longer service life has been strongly required.

As a kind of steel in this field, SUJ 2 (according to JIS), for example, has been widely used as a steel which has improved rolling fatigue life. Since the C and Cr contents are high in this steel kind, large eutectic carbides are formed, so that a long annealing time is necessary for these eutectic carbides. To improve the cuttability of this bearing steel, Japanese Unexamined Patent Publication (Kokai) No. 55-145158 discloses a Te-containing bearing steel and Japanese Unexamined Patent Publication (Kokai) No. 1-255651 discloses a bearing steel to which REM is added. However, a strong demand for higher life of these steels under a high load condition still exists.

In contrast, the inventors of the present invention proposed in Japanese Patent Application No. 6-134535 a high carbon chromium type bearing steel containing suitable amounts of Mg and Mo. Excellent rolling fatigue characteristics can be obtained by using this steel. In order to produce the bearing parts by the high carbon chromium type bearing steel, a spheroidization annealing step and a hardening/tempering step are necessary, and the production cost becomes high. Therefore, the total production cost of the bearing parts using the Mg- and Mo-containing high carbon chromium type bearing steel involving the increase of the material cost becomes remarkably high. For this reason, there is also a strong requirement for low cost during the production of the bearing parts.

DISCLOSURE OF THE INVENTION

It is an object of the present invention to provide a induction-hardened bearing steel which can be used to produce bearing parts at low cost, and which exhibits excellent rolling fatigue characteristics in the bearing parts.

The inventors of the present invention have paid specific attention to induction hardening which will replace the hardening/temperating step of the conventional high carbon chromium type bearing steel, or a carburizing step of a medium carbon steel. Because great compression residual stress occurs in the surface layer of the induction hardened material, longer service life can be effectively obtained. To accomplish a induction hardened bearing steel capable of obtaining excellent rolling fatigue characteristics even under a high load, the present inventors have furthered their studies and have made the following observation.

(1) In rolling fatigue failure under a high load condition, a rolling fatigue failure starts from a nonmetallic inclusion accompanying a white structure with a carbide structure on the periphery thereof. The white structure and the carbide structure involve hardness lowering. The formation of the white structure and the carbide structure is inhibited by making the nonmetallic inclusions fine.

(2) As described above, making nonmetallic inclusions fine is effective in extending the life of the steel. (Making nonmetallic inclusions fine has the following two advantages: (i) reduction of stress concentration which has heretofore been believed to cause crack formation, and (ii) inhibition of the formation of the white structure and the carbide structure which have been newly found.) Moreover, it becomes important to inhibit the formation of the white structures and the carbide structures on the periphery of nonmetallic inclusions in the process of rolling fatigue and prevent hardness lowering thereon.

(3) In order to make the nonmetallic inclusions fine, the addition of Mg in a proper amount, as proposed in Japanese Unexamined Patent Publication (Kokai) No. 7-54103 by the present inventors, is effective. The fundamental concept of this method is as follows: Mg is added to a practical carbon steel containing Al and the oxide composition is converted from $Al_2O_3$ to $MgO.Al_2O_3$ or MgO.; as a result the oxide aggregates are prevented, and the oxide is dispersed in a fine form. Since $Mgo.Al_2O_3$ or MgO has a low surface energy when in contact with molten steel, as compared with $Al_2O_3$, the nonmetallic inclusions do not easily become aggregates, and a fine dispersion thereof is achieved. As described above, making the nonmetallic inclusions fine has two advantages, namely the reduction of stress concentration causing crack formation, and the inhibition of the formation of the white structure and the carbide structure. The addition of Mg is, therefore, greatly effective in extending the life of the bearings made of the steel.

(4) Next, in order to inhibit the formation of the white structure and the carbide structure and to prevent a reduction in hardness, an increase in the Si content is effective, and the addition of Mo is also effective.

(5) In addition to the effects described above, the effects of inhibiting the formation of the white structure and the carbide structure and preventing hardness reduction become greater by adding further Cr, Ni, V, Nb and B.

The present invention has been completed on the basis of the novel finding described above, and its gist resides in the following points.

The invention of each of claims 1 to 4 provides a long-life induction-hardened bearing steel which comprises, in terms of weight: 0.45 to 0.70% of C, 0.05 to 1.70 of Si, 0.35 to 2.0% of Mn, 0.001 to 0.03% of S, 0.010 to 0.07% of Al, 0.003 to 0.015% of N, 0.0005 to 0.0300% of total Mg; or further 0.05 to 1.20% of Mo; or further, one or at least two elements selected from the group consisting of the following elements in the following amounts; 0.03 to 1.50% of Cr, 0.10 to 2.00% of Ni, 0.03 to 0.7% of V, 0.005 to 0.3% of Nb, 0.0005 to 0.005% of B; and further, not more than 0.025% of P, not more than 0.0040% of Ti, not more than 0.0020% total O, and the balance consisting of iron and unavoidable impurities.

In the inventions as set forth in claims 1 to 4, the invention of claim 5 relates to the long-life induction-hardened bearing steel wherein oxides contained in the steel satisfy the following formula in terms of a number ratio:

(number of $MgO.Al_2O_3$+number of MgO)/number of total oxide type inclusions≧0.80.

BEST MODE FOR CARRYING OUT THE INVENTION

The present invention gives specific attention to induction hardening as a step which will replace hardening/tempering of a conventional high carbon chromium type bearing steel or a carburization step of a medium carbon steel in order to produce bearing parts at a low cost, and accomplishes a bearing steel. Since a large compression residual stress occurs in the surface layer of a induction-hardened material, it is effective for improving life and furthermore, excellent rolling fatigue characteristics can be obtained even under a high load condition.

The present invention is explained in detail below. Reasons for restricting the range of the chemical of composition of the steel of the present invention are explained below.

Carbon is an effective element for obtaining a rolling fatigue strength and a wear resistance necessary for bearing parts as the final products. In the case of the induction-hardened steel, the effect of C is not sufficient when its content is less than 0.45%, and when the content exceeds 0.70%, toughness is deteriorated and a deterioration of the strength occurs, on the contrary. Therefore, the C content is defined to be from 0.45 to 0.70%.

Silicon is added for the purpose of deoxidizing and extending the life of the final products by inhibiting the formation of the white structure and the carbide structure and by preventing hardness reduction in the process of rolling fatigue. However, the effects become insufficient when the Si content is less than 0.05%. On the other hand, when the content exceeds 1.70%, such effects are saturated, and the toughness of the final products is rather deteriorated. Accordingly, the Si content is defined to be from 0.05 to 1.70%.

Manganese is an effective element for increasing the life of the final products through the improvement of induction hardenability. When its content is less than 0.35%, however, this effect is not sufficient and if it exceeds 2.0%, on the other hand, the effect are saturated and the deterioration of the toughness of the final products is invited. Therefore, the Mn content is limited to 0.35 to 2.0%.

Sulfur is present in the steel as MnS, and contributes to improve the machinability thereof and make the structure fine. However, when the S content is less than 0.001%, the effects are insufficient. On the other hand, the effects are saturated, and the rolling fatigue characteristics are rather deteriorated, when the S content exceeds 0.03%. For the reason as described above, the S content is defined to be from 0.001 to 0.03%.

Aluminum is added as an element for deoxidation and grain refining, the effects become insufficient when the Al content is less than 0.010%. On the other hand, the effects are saturated, and the toughness is rather deteriorated when the Al content exceeds 0.07%. Accordingly, the Al content is defined to be from 0.010 to 0.07%.

Nitrogen contributes to make austenite grains fine through the precipitation behavior of AlN. However, the effects become insufficient when the N content is less than 0.003%. On the other hand, the effects are saturated, and the toughness is rather deteriorated, when the N content exceeds 0.015%. Accordingly, the N content is defined to be from 0.003 to 0.015%.

Magnesium is a strong deoxidizing element and reacts with $Al_2O_3$ in the steel. It is added in order to deprive $Al_2O_3$ of O and to form $MgO.Al_2O_3$ or MgO. Therefore, unless at least a predetermined amount of Mg is added in accordance with the $Al_2O_3$ amount, that is, in accordance with T.O wt %, unreacted $Al_2O_3$ undesirably remains. As a result of a series of experiments in this connection, it has been found out that remainder of unreacted $Al_2O_3$ can be avoided and the oxides can be completely converted to $MgO.Al_2O_3$ or MgO by limiting the total Mg wt % to at least 0.0005%. However, if Mg is added in an amount exceeding the total Mg wt % of 0.0300%, the Mg carbides and Mg sulfides are formed and the formation of such compounds is not desirable from the aspects of the materials. Therefore, the Mg content is limited to 0.0005 to 0.3000%. By the way, the term "total Mg content" represents hereby the sum of the soluble Mg content in the steel, the Mg content that forms the oxides, and other Mg compounds (that are unavoidably formed).

Phosphorus causes grain boundary segregation and center-line segregation in the steel and results in the deterioration of the strength of the final products. Particularly when the P content exceeds 0.025%, the deterioration of the strength becomes remarkable. Therefore, 0.025% is set as the upper limit of P.

Titanium forms a hard precipitation TiN, which triggers the formation of the white structure and the carbide structure. In other words, it functions as the start point of rolling fatigue failure and results in the deterioration of rolling life of the final products. Particularly when the Ti content exceeds 0.0040%, the deterioration of life becomes remarkable. Therefore, 0.0040% is set as the upper limit of Ti.

In the present invention, the total O content is the sum of the content of O dissolved in the steel and the content of O forming oxides (mainly alumina) in the steel. However, the total O content approximately agrees with the content of O forming the oxides. Accordingly, when the total O content is higher, the amount of $Al_2O_3$ in the steel to be reformed is greater. The limit of the total O content from which the effects of the present invention in the induction-hardened material can be expected has been investigated. As a result, it has been found that when the total O content exceeds 0.0020% by weight, the amount of $Al_2O_3$ becomes excessive and as a result the total amount of $Al_2O_3$ in the steel cannot be converted to $MgO.Al_2O_3$ or MgO to leave alumina in the steel at the time of adding Mg. The total O content in the steel of the present invention must be, therefore, restricted to up to 0.0020% by weight.

Next, the steel according to claim 2 contains Mo in order to prevent hardness reduction in the rolling fatigue process and to inhibit the formation of the white structure and carbide structure.

Mo is added to improve induction hardenability and to improve life of the final products by inhibiting the formation of the white structure and the carbide structure in the rolling fatigue process. When the Mo content is less than 0.05%, however, this effect is not sufficient and when it exceeds 1.2%, on the other hand, the effect is saturated and rather invites the deterioration of the toughness of the final product. Therefore, the Mo content is limited to 0.05 to 1.20%.

Next in the steel according to claims 3 and 4, at least one of Cr, Ni, V, Nb and B is added so as to improve induction hardenability, to prevent hardness reduction in the rolling fatigue process and to inhibit the formation of the white structure and the carbide structure.

Cr: 0.03 to 1.50%,
Ni: 0.10 to 2.00%,
V: 0.03 to 0.7%,
Nb: 0.005 to 0.3%,
B: 0.0005 to 0.005%.

All of these elements improve hardenability, and are effective for preventing repetitive softening by restricting the drop of the dislocation density in the rolling process or by restricting the formation of the cementite in the repetitive process. This effect is not sufficient when C is less than 0.03%, Ni is less than 0.10%, V is less than 0.03%, Nb is less than 0.005% and B is less than 0.005%. On the other hand, when these elements exceed the ranges of Cr: 1.50%, Ni: 2.00%, V: 0.7%, Nb: 0.3% and B: 0.005%, the effect is saturated and rather invites the deterioration of the toughness of the final products. Therefore, the contents are limited to the range described above.

Next, the reasons for limiting the number ratio of the oxide inclusions in the steel according to claim 5 will be explained. In the refining process of steels, oxide inclusions outside the range of the present invention, that is, oxide inclusions other than $MgO.Al_2O_3$ and MgO, exist due to an unavoidable mixture. When the amounts of these inclusions are set to less than 20% of the total in terms of the number ratio, fine dispersion of the oxide inclusions can be highly stabilized, and further improvements in the materials can be recongnized. Therefore, the number ratio is limited to (numbr of $MgO.Al_2O_3$+number of MgO/number of total oxide type inclusions≧0.8.

By the way, in order to bring the number ratio of the oxide inclusions into the range of the present invention, it is an effective method to prevent mixture of oxides of an external system such as those from refractories, but the present invention does not particularly limit the production condition relating to this requirement.

The production method of the steel according to the present invention is not particularly limited. In other words, melting of a base molten steel may be carried out by a blast furnace-converter method or an electric furnace method. The method of adding the components to the mother molten steel is not particularly limited, either, and a metal containing each component to be added or its alloy may be added to the mother molten steel. The method of addition, too, may be an addition method utilizing natural dropping, a blowing method using an inert gas, a method which supplies an iron wire, into which an Mg source is filled, into the molten steel, and so forth. Further, the method of producing a steel ingot from the mother molten steel and rolling the steel ingot is not particularly limited, either.

Though the present invention is directed to the steel for the bearing parts produced by the induction-hardening process, the induction-hardening condition, the existence of tempering, the tempering condition when it is effected, etc, are not particularly limited.

Hereinafter, the effects of the present invention will be represented more concretely with reference to Examples.

EXAMPLES

Steel blooms each having the chemical compositions tabulated in Table 1 or 2 were produced by a blast furnace-converter-continuous casting method. Mg was added by a method which supplied an iron wire packed with a mixture of metallic Mg particles and Fe-Si alloy particles into the molten steel, inside a ladle, discharged from the converter.

Next, round bars having a diameter of 65 mmϕ were produced by bloom rolling and bar rolling. The number ratio of oxides in the section of the steel materials in the rolling direction and the sizes of the oxides were measured. As a result, all the steels according to the present invention fell within the suitable range as tabulated in Tables 3 and 4. A testpiece for the rolling fatigue test was collected and prepared from each steel material of the present invention, was then induction hardened at a frequency of 100 KHz and a hardened layer depth of 2 to 3 mm, and was thereafter tempered at 160° C. Rolling fatigue life was evaluated by using a Mori thrust-type contact rolling fatigue tester (Herzian maximum contact stress of 540 $kgf/mm^2$) and a point contact type rolling fatigue tester (Herzian maximum contact stress of 600 $kgf/mm^2$) using cylindrical rolling fatigue testpieces. As the scale of fatigue life, "the number of repetitions of stress till fatigue failure at a cumulative destruction probability of 10% obtained by plotting test results on a Weibull chart" is generally used as $L_{10}$ life. In Tables 3 and 4, a relative value of this $L_{10}$ life of each steel material, when $L_{10}$ life of Comparative Example No. 34 was set to 1, was also shown. The steels of the present invention had more excellent fatigue characteristics than the Comparative steels. Further, the existence of the white structure and the carbide structure was examined in each testpiece after rolling fatigue of $10^8$ times, and the result was also shown in Tables 3 and 4.

In Comparative Example 34, the ratio of the MgO type oxide was 0, and the size of the oxides was a maximum of 20 μm and was coarse. In contrast, the Comparative Example 37 represented the material to which a suitable amount Mg was added to the components approximate to those of Comparative Example 34. The ratio of the MgO type oxide became 0.76, and the size of the oxides was reduced to 7 μm maximum. As a result, though the white structure and the carbide structure were formed in the rolling fatigue process, the particles became finer than in Comparative Example 34. In comparison with Comparative Example 34, the rolling fatigue characteristics were less than 6 times in both the Mori thrust type contact rolling fatigue test and the point contact type rolling fatigue characteristics and were not sufficient. This was because the amount of addition of Si was lower than the range of the present invention in Comparative Example 37, and the white structure and the carbide structure were formed in the rolling fatigue process, though the quantity was slight.

Next, Comparative Examples 35 and 36 represent the cases where the component system other than Mg was within the range of the present invention, but the amount of addition of Mg was smaller than the range of the present invention in Comparative Example 35 while it was greater in Comparative Example 36. In Comparative Example 35, the ratio of the MgO type oxides was as low as 0.48, and the size of the oxides was as coarse as 14 μm maximum. In Comparative Example 36, the ratio of MgO type oxides was high, but coarse MgO was formed due to the excessive addition of Mg, and the size of the oxides was also as coarse as 14 μm maximum. In comparison with Comparative Example 34, the white structure and the carbide structure were formed, though limitedly, in the rolling fatigue process. As a result, the rolling fatigue characteristics of these Comparative Examples were less than 5 times in both the Mori thrust type contact rolling fatigue test and point contact type rolling fatigue test in comparison with Comparative Example 34, and the rolling fatigue characteristics were not sufficient.

In contrast, in the steels according to the present invention, the ratio of the MgO type oxides was at least 0.7, and the size of the oxides was as fine as 9 μm maximum.

Furthermore, the formation of the white structure and the carbide structure was restricted by optimizing the Si content and others. Accordingly, in comparison with Comparative Example 34 of the prior art steel, the steels of the present invention had extremely excellent fatigue characteristics of about 6 to about 11 times in the Mori system thrust type contact rolling fatigue test and about 6 to about 15 times in the point contact type rolling fatigue test. Particularly, Example 5 of the present invention had extremely excellent rolling life of at least about 8 times in the Mori thrust type contact rolling fatigue test and at least about 9 times in the point contact type rolling fatigue test in comparison with the prior art steels.

TABLE 1

| | No. | C | Si | Mn | S | Al | N | T.Mg | P | Ti | T.O | Mo | Cr | Ni | V | Nb | B | (wt. %) Note |
|---|---|---|---|---|---|---|---|---|---|---|---|---|---|---|---|---|---|---|
| steel of invention | 1 | 0.48 | 0.36 | 1.51 | 0.003 | 0.023 | 0.006 | 0.0010 | 0.012 | 0.0012 | 0.0008 | — | — | — | — | — | — | |
| | 2 | 0.55 | 1.18 | 1.01 | 0.005 | 0.031 | 0.009 | 0.0033 | 0.009 | 0.0013 | 0.0009 | — | — | — | — | — | — | |
| | 3 | 0.63 | 0.12 | 0.66 | 0.008 | 0.016 | 0.012 | 0.0242 | 0.015 | 0.0016 | 0.0014 | — | — | — | — | — | — | |
| | 4 | 0.55 | 0.36 | 1.01 | 0.009 | 0.027 | 0.006 | 0.0030 | 0.012 | 0.0019 | 0.0008 | 0.12 | — | — | — | — | — | |
| | 5 | 0.51 | 1.02 | 0.43 | 0.004 | 0.019 | 0.006 | 0.0035 | 0.016 | 0.0015 | 0.0009 | 0.72 | — | — | — | — | — | |
| | 6 | 0.60 | 0.37 | 0.52 | 0.006 | 0.030 | 0.008 | 0.0025 | 0.014 | 0.0016 | 0.0007 | 0.50 | — | — | — | — | — | |
| | 7 | 0.55 | 0.25 | 1.36 | 0.004 | 0.025 | 0.006 | 0.0031 | 0.016 | 0.0013 | 0.0007 | — | 0.41 | — | — | — | — | |
| | 8 | 0.54 | 0.37 | 1.04 | 0.008 | 0.032 | 0.004 | 0.0030 | 0.013 | 0.0014 | 0.0008 | — | — | — | — | — | 0.0025 | |
| | 9 | 0.58 | 0.30 | 0.82 | 0.006 | 0.020 | 0.004 | 0.0030 | 0.009 | 0.0016 | 0.0007 | — | — | — | 0.13 | — | — | |
| | 10 | 0.66 | 1.42 | 0.78 | 0.005 | 0.025 | 0.006 | 0.0039 | 0.012 | 0.0014 | 0.0005 | — | 0.14 | 1.02 | — | 0.022 | — | |
| | 11 | 0.58 | 0.28 | 0.75 | 0.008 | 0.026 | 0.009 | 0.0027 | 0.017 | 0.0015 | 0.0006 | 0.23 | 0.34 | — | — | — | — | |
| | 12 | 0.54 | 0.38 | 0.97 | 0.006 | 0.029 | 0.004 | 0.0031 | 0.015 | 0.0016 | 0.0007 | 0.18 | — | — | — | — | 0.0023 | |
| | 13 | 0.60 | 0.39 | 0.89 | 0.006 | 0.025 | 0.005 | 0.0010 | 0.015 | 0.0014 | 0.0006 | 0.53 | — | — | 0.15 | — | — | |
| | 14 | 0.53 | 0.36 | 1.03 | 0.007 | 0.030 | 0.006 | 0.0062 | 0.016 | 0.0015 | 0.0006 | 0.26 | — | 0.57 | — | 0.030 | — | |
| | 15 | 0.57 | 1.14 | 0.62 | 0.005 | 0.024 | 0.006 | 0.0033 | 0.014 | 0.0014 | 0.0006 | 0.17 | — | 0.82 | — | — | — | |
| | 16 | 0.55 | 0.36 | 0.56 | 0.007 | 0.026 | 0.006 | 0.0030 | 0.009 | 0.0013 | 0.0007 | 0.27 | 0.41 | 0.30 | 0.10 | — | 0.0020 | |
| | 17 | 0.53 | 0.08 | 0.97 | 0.006 | 0.028 | 0.008 | 0.0016 | 0.011 | 0.0012 | 0.0009 | — | — | — | — | — | — | |
| | 18 | 0.53 | 1.62 | 1.03 | 0.004 | 0.024 | 0.006 | 0.0024 | 0.009 | 0.0013 | 0.0007 | — | — | — | — | — | — | |
| | 19 | 0.54 | 0.93 | 1.86 | 0.006 | 0.031 | 0.006 | 0.0018 | 0.016 | 0.0015 | 0.0006 | — | — | — | — | — | — | |
| | 20 | 0.56 | 0.96 | 0.98 | 0.004 | 0.026 | 0.007 | 0.0007 | 0.014 | 0.0014 | 0.0006 | — | — | — | — | — | — | |

TABLE 2

| | No. | C | Si | Mn | S | Al | N | T.Mg | P | Ti | T.O | Mo | Cr | Ni | V | Nb | B | (wt. %) Note |
|---|---|---|---|---|---|---|---|---|---|---|---|---|---|---|---|---|---|---|
| steel of invention | 21 | 0.53 | 0.91 | 0.96 | 0.008 | 0.025 | 0.007 | 0.0263 | 0.015 | 0.0015 | 0.0007 | — | — | — | — | — | — | |
| | 22 | 0.54 | 1.03 | 1.02 | 0.006 | 0.026 | 0.006 | 0.0017 | 0.015 | 0.0014 | 0.0006 | 0.06 | — | — | — | — | — | |
| | 23 | 0.53 | 0.98 | 1.02 | 0.005 | 0.024 | 0.006 | 0.0021 | 0.017 | 0.0016 | 0.0005 | 1.04 | — | — | — | — | — | |
| | 24 | 0.55 | 1.02 | 1.13 | 0.008 | 0.030 | 0.006 | 0.0024 | 0.012 | 0.0015 | 0.0007 | — | 0.05 | — | — | — | — | |
| | 25 | 0.50 | 1.14 | 1.02 | 0.006 | 0.025 | 0.005 | 0.0016 | 0.009 | 0.0014 | 0.0008 | — | 1.31 | — | — | — | — | |
| | 26 | 0.53 | 1.02 | 0.97 | 0.006 | 0.029 | 0.004 | 0.0019 | 0.013 | 0.0016 | 0.0007 | — | — | 0.15 | — | — | — | |
| | 27 | 0.51 | 0.96 | 0.98 | 0.007 | 0.026 | 0.009 | 0.0020 | 0.016 | 0.0014 | 0.0007 | — | — | 1.82 | — | — | — | |
| | 28 | 0.52 | 0.07 | 1.03 | 0.005 | 0.025 | 0.006 | 0.0017 | 0.014 | 0.0013 | 0.0009 | 0.43 | — | — | — | — | — | |
| | 29 | 0.52 | 1.64 | 1.01 | 0.008 | 0.032 | 0.004 | 0.0025 | 0.015 | 0.0016 | 0.0008 | 0.54 | — | — | — | — | — | |
| | 30 | 0.55 | 0.98 | 1.05 | 0.006 | 0.025 | 0.004 | 0.0008 | 0.012 | 0.0015 | 0.0014 | 0.37 | — | — | — | — | — | |
| | 31 | 0.54 | 0.97 | 0.98 | 0.007 | 0.020 | 0.006 | 0.0267 | 0.015 | 0.0019 | 0.0009 | 0.41 | — | — | — | — | — | |
| | 32 | 0.53 | 1.01 | 0.96 | 0.005 | 0.019 | 0.008 | 0.0027 | 0.009 | 0.0016 | 0.0008 | 0.22 | 0.06 | — | — | — | — | |
| | 33 | 0.53 | 1.03 | 1.00 | 0.007 | 0.027 | 0.006 | 0.0026 | 0.012 | 0.0013 | 0.0007 | 0.18 | — | 0.18 | — | — | — | |
| Comp. steel | 34 | 0.53 | 0.26 | 0.83 | 0.006 | 0.025 | 0.009 | — | 0.015 | 0.0014 | 0.0007 | — | — | — | — | — | — | no Mg addition |
| | 35 | 0.59 | 0.36 | 0.75 | 0.006 | 0.026 | 0.007 | 0.0003 | 0.010 | 0.0016 | 0.0008 | — | — | — | — | — | — | Mg ≦ lower limit |
| | 36 | 0.58 | 0.37 | 0.81 | 0.005 | 0.031 | 0.007 | 0.0331 | 0.011 | 0.0012 | 0.0007 | — | — | — | — | — | — | Mg ≧ upper limit |
| | 37 | 0.53 | 0.03 | 0.78 | 0.006 | 0.024 | 0.006 | 0.0032 | 0.009 | 0.0013 | 0.0007 | — | — | — | — | — | — | Si ≦ lower limit |

TABLE 3

| | | oxides | | Mori's thrust type contact rolling fatigue test | | point contact type rolling fatigue test | | |
|---|---|---|---|---|---|---|---|---|
| | No. | size (μm) | number ratio | $L_{10}$ | Presence of white/carbide structure | $L_{10}$ | presence of white/carbide structure | note |
| steel of invention | 1 | 3-7 | 0.75 | 6.3 | no | 6.5 | no | First aspect of invention |
| | 2 | 2-7 | 0.91 | 7.8 | " | 11.3 | " | Fifth aspect of invention |
| | 3 | 2-7 | 0.73 | 6.6 | " | 6.1 | " | First aspect of invention |
| | 4 | 3-7 | 0.76 | 8.7 | " | 13.1 | " | Second aspect of invention |
| | 5 | 3-7 | 0.78 | 9.6 | " | 13.4 | " | Second aspect of invention |
| | 6 | 2-7 | 0.85 | 10.6 | " | 14.9 | " | Fifth aspect of invention |
| | 7 | 2-7 | 0.73 | 7.2 | " | 7.4 | " | Third aspect of invention |
| | 8 | 2-7 | 0.84 | 8.2 | " | 9.1 | " | Fifth aspect of invention |
| | 9 | 3-8 | 0.76 | 6.8 | " | 6.5 | " | Third aspect of invention |
| | 10 | 3-7 | 0.76 | 7.4 | " | 7.0 | " | Third aspect of invention |
| | 11 | 2-7 | 0.77 | 9.3 | " | 10.1 | " | Fourth aspect of invention |
| | 12 | 2-7 | 0.86 | 10.0 | " | 11.8 | " | Fifth aspect of invention |
| | 13 | 2-7 | 0.76 | 8.9 | " | 13.5 | " | Fourth aspect of invention |
| | 14 | 3-7 | 0.73 | 8.6 | " | 10.4 | " | Fourth aspect of invention |
| | 15 | 2-7 | 0.89 | 9.7 | " | 14.6 | " | Fifth aspect of invention |
| | 16 | 2-7 | 0.76 | 8.5 | " | 10.7 | " | Fourth aspect of invention |
| | 17 | 2-7 | 0.73 | 6.2 | " | 6.7 | " | First aspect of invention |
| | 18 | 2-7 | 0.82 | 6.8 | " | 7.9 | " | Fifth aspect of invention |
| | 19 | 2-7 | 0.78 | 6.7 | " | 6.5 | " | First aspect of invention |
| | 20 | 3-8 | 0.70 | 6.2 | " | 6.8 | " | First aspect of invention |

Note:
1. The size of oxides designates equivalent spherical diameter present per $mm^2$ of an area.
2. The number ratio of oxides: (number of MgO $Al_2O_3$ + number of MgO per 1 $mm^2$)/total number of the entire oxide inclusions, provided that the numbers are based on $mm^2$.
3. $L_{10}$: relative value on the basis of $L_{10}$ which is defined on be 1 in Comparative Example 17.

TABLE 4

| | | oxide | | Mori's thrust type contact rolling fatigue test | | point contact type rolling fatigue test | | |
|---|---|---|---|---|---|---|---|---|
| | No. | size (μm) | number ratio | $L_{10}$ | Presence of white/carbide structure | $L_{10}$ | presence of white/carbide structure | note |
| steel of invention | 21 | 2-9 | 0.93 | 6.3 | no | 6.9 | no | Fifth aspect of invention |
| | 22 | 2-7 | 0.73 | 6.5 | " | 6.3 | " | Second aspect of invention |
| | 23 | 2-7 | 0.78 | 7.4 | " | 8.2 | " | Second aspect of invention |
| | 24 | 2-7 | 0.80 | 6.4 | " | 6.3 | " | Fifth aspect of invention |
| | 25 | 2-7 | 0.74 | 6.3 | " | 6.6 | " | Third aspect of invention |
| | 26 | 2-7 | 0.77 | 6.3 | " | 6.3 | " | Third aspect of invention |
| | 27 | 2-7 | 0.78 | 7.3 | " | 7.9 | " | Third aspect of invention |
| | 28 | 2-7 | 0.74 | 9.5 | " | 12.8 | " | Second aspect of invention |
| | 29 | 2-7 | 0.81 | 9.7 | " | 13.1 | " | Fifth aspect of invention |
| | 30 | 3-8 | 0.70 | 8.5 | " | 11.0 | " | Second aspect of invention |
| | 31 | 2-9 | 0.92 | 7.7 | " | 10.7 | " | Fifth aspect of invention |
| | 32 | 2-7 | 0.81 | 8.2 | " | 11.4 | " | Fifth aspect of invention |
| | 33 | 2-7 | 0.80 | 9.0 | " | 12.3 | " | Fifth aspect of invention |
| Comp. steel | 34 | 5-20 | 0 | 1 | yes | 1 | yes | |
| | 35 | 5-14 | 0.48 | 3.6 | " | 3.9 | " | |
| | 36 | 4-14 | 0.91 | 4.2 | " | 4.8 | " | |
| | 37 | 2-7 | 0.76 | 5.3 | " | 5.1 | " | |

INDUSTRIAL APPLICABILITY

As described above, the induction hardened bearing steel of the present invention can realize the formation of fine oxide inclusions, the inhibition of forming white structures and carbide structures and the prevention of hardness reduction. As a result, it has become possible to provide a bearing steel which may greatly improve, in bearing parts, the rolling fatigue life under a high load. Accordingly, the effects of the present invention in industry are extremely significant.

We claim:

1. A long-life induction-hardened bearing steel consisting essentially of, in terms of percent by weight:

C: 0.45 to 0.70%,
Si:0.05 to 1.70%,
Mn: 0.35 to 2.0%,
S: 0.001 to 0.03%,
Al: 0.010 to 0.07%,
N: 0.003 to 0.015%,
Total Mg: 0.0005 to 0.0300%,
P: not more than 0.025%,
Ti: not more than 0.0040%,
Total O: not more than 0.0020%, and the balance consisting of iron and unavoidable impurities.

2. A long-life induction hardened bearing steel consisting essentially of, in terms of percent by weight:
C: 0.45 to 0.70%,
Si: 0.05 to 1.70%,
Mn: 0.35 to 2.0%,
Mo: 0.05 to 1.20%,
S: 0.001 to 0.03%,
Al: 0.010 to 0.07%,
N: 0.003 to 0.015%,
Total Mg: 0.0005 to 0.0300%,
P: not more than 0.025%,
Ti: not more than 0.0040%,
Total O: not more than 0.0020%,
and the balance consisting of iron and unavoidable impurities.

3. A long life induction-hardened bearing steel consisting essentially of, in terms of percent by weight:
C: 0.45 to 0.70%,
Si:0.05 to 1.70%,
Mn: 0.35 to 2.0%,
S: 0.001 to 0.03%,
Al: 0.010 to 0.07%,
N: 0.003 to 0.015%,
Total Mg: 0.0005 to 0.0300%,
at least one of the members selected from the group consisting of:
Cr: 0.03 to 1.50%,
Ni: 0.10 to 2.00%,
V: 0.03 to 0.7%,
Nb: 0.005 to 0.3%,
B: 0.0005 to 0.005%; and
P: not more than 0.025%,
Ti: not more than 0.0040%,
Total O: not more than 0.0020%,
and the balance consisting of iron and unavoidable impurities.

4. A long life induction-hardened bearing steel comprising, in terms of percent by weight:
C: 0.45 to 0.70%,
Si: 0.05 to 1.70%,
Mn: 0.35 to 2.0%,
Mo: 0.05 to 1.20%,
S: 0.001 to 0.03%,
Al: 0.010 to 0.07%,
N: 0.003 to 0.015%,
Total Mg: 0.0005 to 0.0300%,
at least one of the members selected from the group consisting of:
Cr: 0.03 to 1.50%,
Ni: 0.10 to 2.00%,
V: 0.03 to 0.7%,
Nb: 0.005 to 0.3%,
B: 0.0005 to 0.0050%; and
P: not more than 0.025%,
Ti: not more than 0.0040%,
Total O: not more than 0.0020%,
and the balance consisting of iron and unavoidable impurities.

5. A long life induction-hardened bearing steel according to claim 1, wherein oxides contained in said steel satisfy the following formula as a number ratio:

(number of $MgO.Al_2O_3$+number of MgO/number of total oxide type inclusions≧0.80.

6. A long life induction-hardened bearing steel according to claim 2, wherein oxides contained in said steel satisfy the following formula as a number ratio:

(number of $MgO.Al_2O_3$+number of MgO/number of total oxide type inclusions≧0.80.

7. A long life induction-hardened bearing steel according to claim 3, wherein oxides contained in said steel satisfy the following formula as a number ratio:

(number of $MgO.Al_2O_3$+number of MgO/number of total oxide type inclusions≧0.80.

8. A long life induction-hardened bearing steel according to claim 4, wherein oxides contained in said steel satisfy the following formula as a number ratio:

(number of $MgO.Al_2O_3$+number of MgO/number of total oxide type inclusions≧0.80.

9. A long-life induction hardened bearing steel according to claim 1, 2, 3 or 4 wherein oxides in said steel have a size of not more than 9 μm.

10. A long-life induction hardened bearing steel according to claim 9 wherein C is 0.45 to 0.66%.

11. A long-life induction hardened bearing steel according to claim 10 wherein said steel has a metallic structure comprising martensite.

* * * * *